US009759523B2

(12) United States Patent
Pekarek et al.

(10) Patent No.: US 9,759,523 B2
(45) Date of Patent: Sep. 12, 2017

(54) METHOD AND APPARATUS FOR ABSORBING SHOCK IN AN OPTICAL SYSTEM

(71) Applicant: DRS Network & Imaging Systems, LLC, Melbourne, FL (US)

(72) Inventors: Brian Pekarek, Dallas, TX (US); Kenneth Pietrasik, Murphy, TX (US)

(73) Assignee: DRS Network & Imaging Systems, LLC, Melbourne, FL (US)

( * ) Notice: Subject to any disclaimer, the term of this patent is extended or adjusted under 35 U.S.C. 154(b) by 0 days.

(21) Appl. No.: 15/185,902

(22) Filed: Jun. 17, 2016

(65) Prior Publication Data

US 2016/0290767 A1 Oct. 6, 2016

Related U.S. Application Data

(62) Division of application No. 14/206,012, filed on Mar. 12, 2014, now Pat. No. 9,400,157.

(60) Provisional application No. 61/785,117, filed on Mar. 14, 2013.

(51) Int. Cl.
*F41G 1/00* (2006.01)
*F41G 11/00* (2006.01)

(52) U.S. Cl.
CPC ..... *F41G 11/002* (2013.01); *F41G 11/003* (2013.01)

(58) Field of Classification Search
CPC ..... F41G 11/02
USPC ..... 42/111–148
See application file for complete search history.

(56) References Cited

U.S. PATENT DOCUMENTS 1,371,964 A * 3/1921 Yaggi ..... F41G 1/40 359/405
2,510,289 A * 6/1950 Livermore ..... F41G 11/002 42/125
3,553,843 A * 1/1971 Sophinos et al. ..... F41G 1/48 42/105
4,026,054 A * 5/1977 Snyder ..... F41G 11/002 362/110
4,161,076 A * 7/1979 Snyder ..... F41G 11/002 362/113

(Continued)

OTHER PUBLICATIONS

U.S. Appl. No. 14/206,012, Non-Final Office Action mailed Nov. 25, 2015, 8 pages.

(Continued)

*Primary Examiner* — Samir Abdosh
(74) *Attorney, Agent, or Firm* — Kilpatrick Townsend & Stockton LLP

(57) ABSTRACT

A shock attenuation system configured to reduce shock experienced by an optical device coupled to a weapon includes an inner rail support configured to couple to the weapon and at least two outer rail supports substantially parallel to the inner rail support. The at least two outer rail supports are configured to couple to the optical device. The shock attenuation system also includes a first spring feature coupled to a first of the at least two outer rail supports and the inner rail support, and a second spring feature coupled to a second of the at least two outer rail supports and the inner rail support. The shock attenuation system further includes a viscoelastic material coupled to at least one of: the inner rail support, the first outer rail support, the second outer rail support, the first spring feature, or the second spring feature.

20 Claims, 17 Drawing Sheets

(56) References Cited

U.S. PATENT DOCUMENTS

| | | | | | |
|---|---|---|---|---|---|
| 4,168,588 | A * | 9/1979 | Snyder | F41G 11/002 | 42/115 |
| 4,295,289 | A * | 10/1981 | Snyder | F41G 11/002 | 362/113 |
| 4,884,347 | A * | 12/1989 | Larson | F41G 1/467 | 124/87 |
| 5,425,191 | A * | 6/1995 | Taylor | F41G 11/002 | 42/124 |
| 8,161,674 | B2 * | 4/2012 | Holmberg | F41C 27/00 | 42/124 |
| 8,322,066 | B2 * | 12/2012 | Westra | F41G 11/004 | 42/146 |
| 8,371,729 | B2 * | 2/2013 | Sharrah | F21S 9/02 | 362/439 |

OTHER PUBLICATIONS

U.S. Appl. No. 14/206,012, Notice of Allowance mailed Mar. 28, 2016, 7 pages.

* cited by examiner

METHOD AND APPARATUS FOR ABSORBING SHOCK IN AN OPTICAL SYSTEM

CROSS-REFERENCES TO RELATED APPLICATIONS

This application is a divisional of U.S. patent application Ser. No. 14/206,012, filed Mar. 12, 2014, which claims priority to U.S. Provisional Patent Application No. 61/785,117, filed Mar. 14, 2013, entitled "Method and Apparatus for Absorbing Shock in an Optical System," the disclosures of which are hereby incorporated by reference in their entirety for all purposes.

BACKGROUND OF THE INVENTION

The shock generated by a weapon such as a gun during gunfire may be severe. Therefore, any device being used with the weapon or otherwise connected to the weapon, such as an optical device, may be damaged upon use of the gun due to that shock.

Therefore, there is a need in the art for improved methods and systems to isolate the device such that shock traveling from the weapon to the device is substantially attenuated.

SUMMARY OF THE INVENTION

The present invention relates generally to weapons systems, and more particularly, to a weapon system with an apparatus, such as an attenuator or isolator, for absorbing shock from a weapon such as a gun to an optical device.

Numerous benefits are achieved by way of embodiments of the present invention over conventional techniques. For example, embodiments of the present invention provide a shock attenuator/isolator that reduces shock experienced by an optical device, or another device attached to the attenuator, during operation of a weapon to acceptable levels, for example, less than 250 g's. The attenuator can protect the functionality of the device by attenuating its exposure to shock from the weapon. Furthermore, the attenuator may be lightweight, durable/strong, compact, and allow the weapon system to maintain acceptable boresight.

A system, according to an embodiment of the present invention, having an optical device and a shock attenuator is provided. The optical device is configured to operate with a weapon. The shock attenuator is disposed between the optical device and the weapon. The system includes the shock attenuator that is configured to reduce shock experienced by the optical device during operation of the weapon to less than 250 g's.

In a particular embodiment, the system includes a rail grabber and an accessory rail. The shock attenuator is disposed between the optical device and the rail grabber. The accessory rail is configured to couple to the weapon and to the rail grabber. A weapon, such as a rifle, is configured to attach to the accessory rail.

A shock attenuator, according to another embodiment of the present invention, operable with a weapon and an optical device is provided. The shock attenuator comprises a weapon support configured to couple to an accessory rail of the weapon, the weapon being characterized by a predetermined g load during operation. The shock attenuator also comprises an optical device support configured to couple to the optical device. The shock attenuator also comprises a spring feature configured to couple to the rail support to the optical device support. The shock attenuator is also configured to reduce shock experienced by the optical device during operation of the weapon to less than the predetermined g load.

A shock attenuation system, according to another embodiment of the present invention, configured to reduce shock experienced by an optical device coupled to a weapon is provided. The shock attenuation system comprises an inner rail support configured to couple to the weapon. The shock attenuation system also comprises at least two outer rail supports substantially parallel to the inner rail support, wherein the at least two outer rail supports are configured to couple to the optical device. The shock attenuation system also comprises a first spring feature coupled to a first of the at least two outer rail supports and the inner rail support, and a second spring feature coupled to a second of the at least two outer rail supports and the inner rail support. The shock attenuation system also comprises a viscoelastic material coupled to at least one of the group of: the inner rail support, the first outer rail support, the second outer rail support, the first spring feature, and the second spring feature.

These and other embodiments of the invention along with many of its advantages and features are described in more detail in conjunction with the text below and attached figures.

BRIEF DESCRIPTION OF THE DRAWINGS

Embodiments of the present invention are described below with reference to the attached drawings, in which.

DETAILED DESCRIPTION OF SPECIFIC EMBODIMENTS

According to embodiments of the present invention, an apparatus related to weapon systems is provided. More particularly, embodiments of the present invention relate to a weapon system with an apparatus, such as an attenuator or isolator, for absorbing shock from a weapon such as a gun (e.g., a rifle) to an optical device. The shock attenuator (or "attenuator" herein) can be mounted between, for example, a sniper rifle and an optical device. The attenuator can reduce the shock felt by the optical device from as much as several thousand g's or more down to a predetermined level (e.g., below 250 g's). The attenuator design, composition and placement can be optimized to reduce or minimize the shock felt by the optical device. The shock attenuator can protect the functionality of the scope by isolating the optical device from the rifle to attenuate the shock exposure of the optical device. The attenuator can be lightweight, compact, and allow the weapon to maintain its lightweight feel while remaining durable and maintain acceptable boresight.

Embodiments of the present invention, along with many of their advantages and features, are described in more detail in conjunction with the text below and its related figures.

Figure 1:
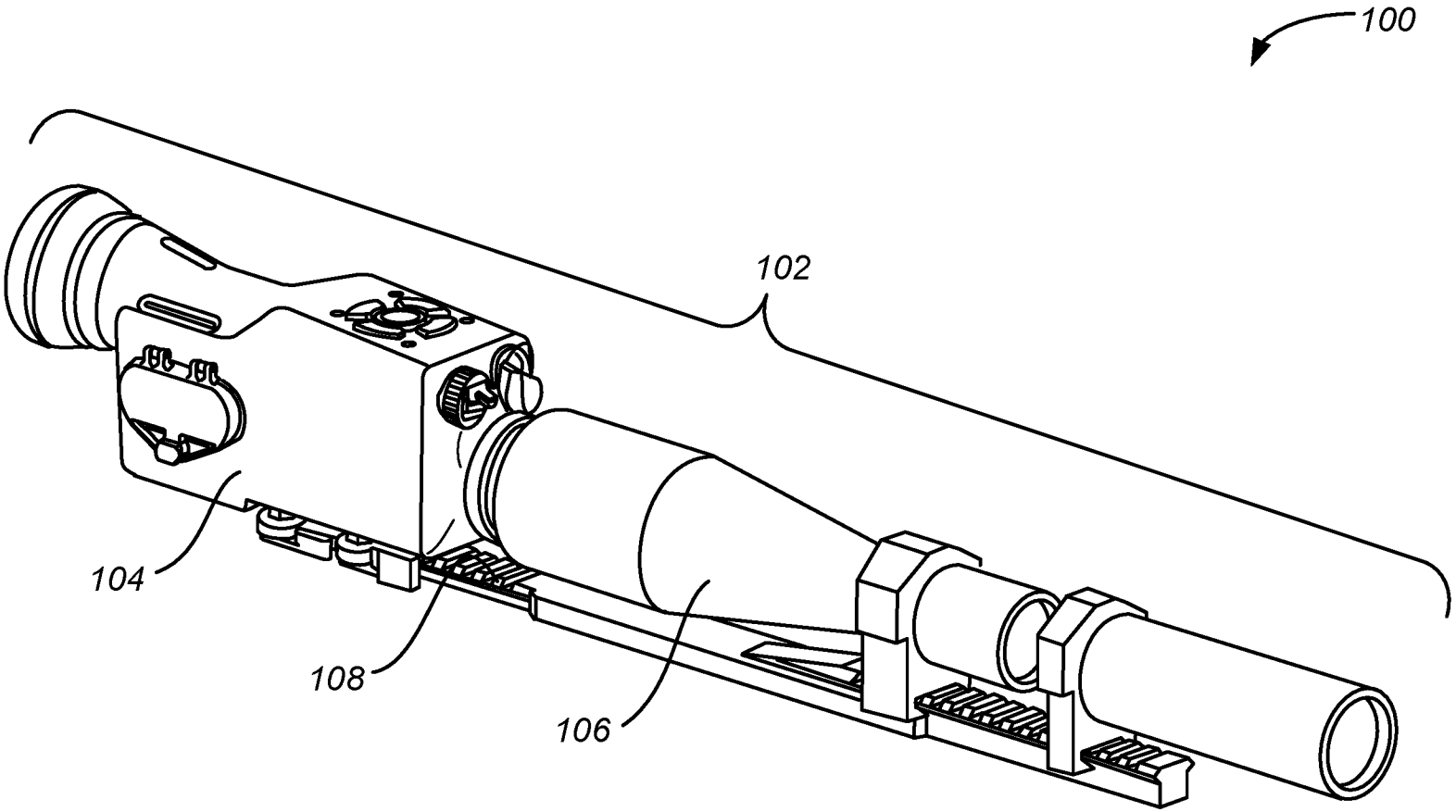
FIG. 1 illustrates a weapon system that includes an optical device and an accessory rail, according to embodiments of the present invention.

FIG. 1 shows a weapon system 100 that includes an optical device 102 and an accessory rail 108, according to embodiments of the present invention. Optical device 102 includes night vision sight 104 and optical telescopic sight 106. Optical telescopic sight 106 is a sighting device, based on a telescope, which may be attached to the top of a gun, such as a rifle, to allow the user of the rifle to view an enhanced image of its target. Night vision sight 104 allows a user to utilize the optical telescopic sight 106 when located in a dark environment. Optical device 102 is configured to couple to a gun, such as a rifle, via an accessory rail or other connecting device that is attached to the gun, such as accessory rail 108. Accessory rail 108 provides a mounting platform for accessories and attachments, such as optical device 102.

Although optical device 102 includes night vision sight 104 and optical telescopic sight 106 in FIG. 1, a variety of other sights could be used in conjunction with embodiments of the present invention. For example, such possible optical devices include, for example, a night vision rifle scope, an open sight, an aperture sight, a red dot sight, a laser sight, a "clip-on" style sight with an actively cooled detector, an objective lens assembly (OLA), an eyepiece assembly, electronic boards and interconnect, a combination of these sights, or other various optical devices on the market.

Since an optical device is generally directly connected to an accessory rail of the gun, the optical device may experience shock when the gun is fired that travels from the gun to the optical device through the accessory rail. Such shock may be severe. Such shock may cause damage to the expensive components of the optical device. However, according to embodiments of the present invention, a shock attenuator may be placed in between the gun and optical device to isolate the optical device from the gun and attenuate a portion of the shock traveling to the optical device from the gun.

Figure 2A:
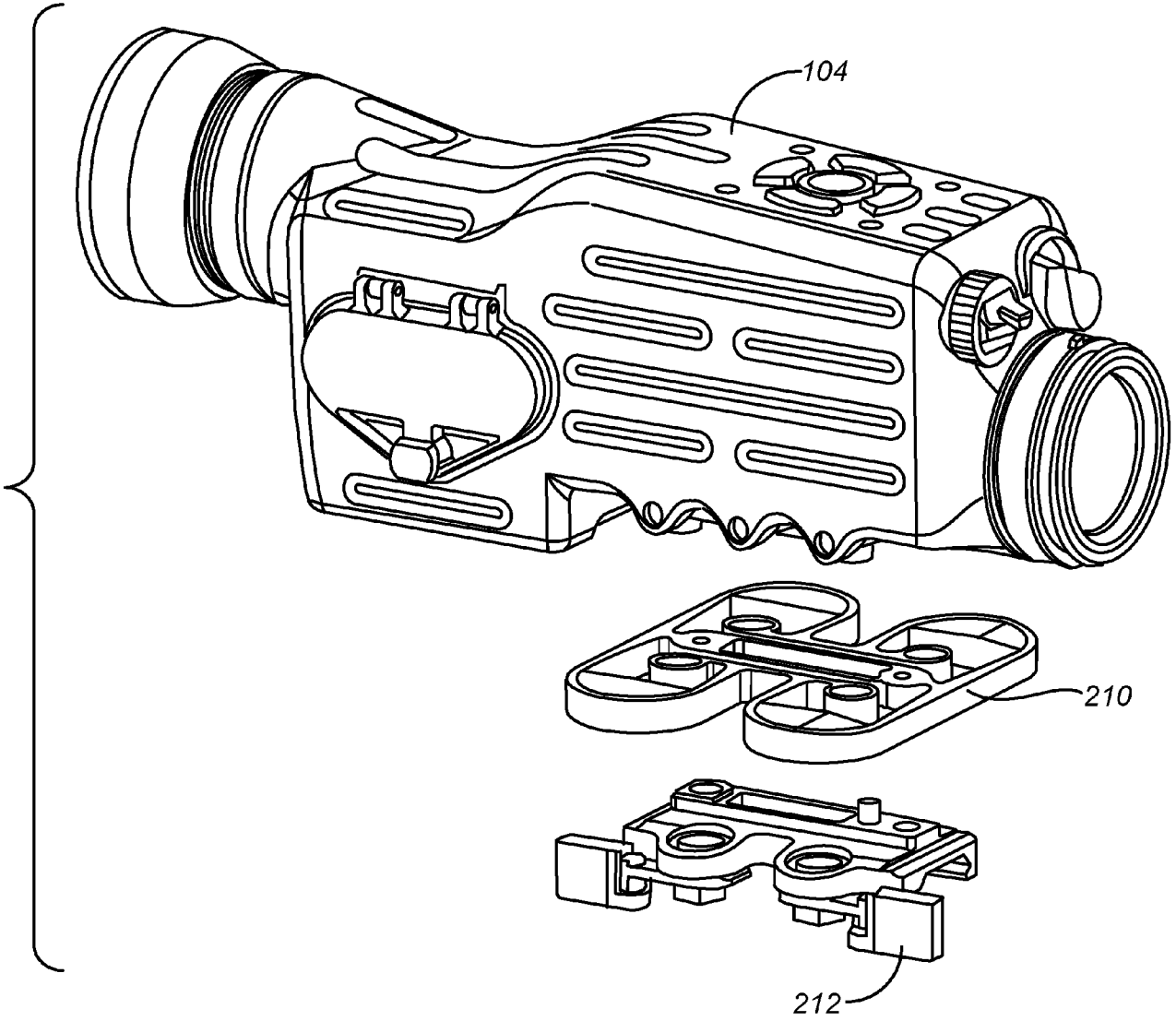
FIG. 2A illustrates an exemplary night vision sight situated as it would be situated when connected to an accessory rail, according to embodiments of the present invention.
Figure 2B:
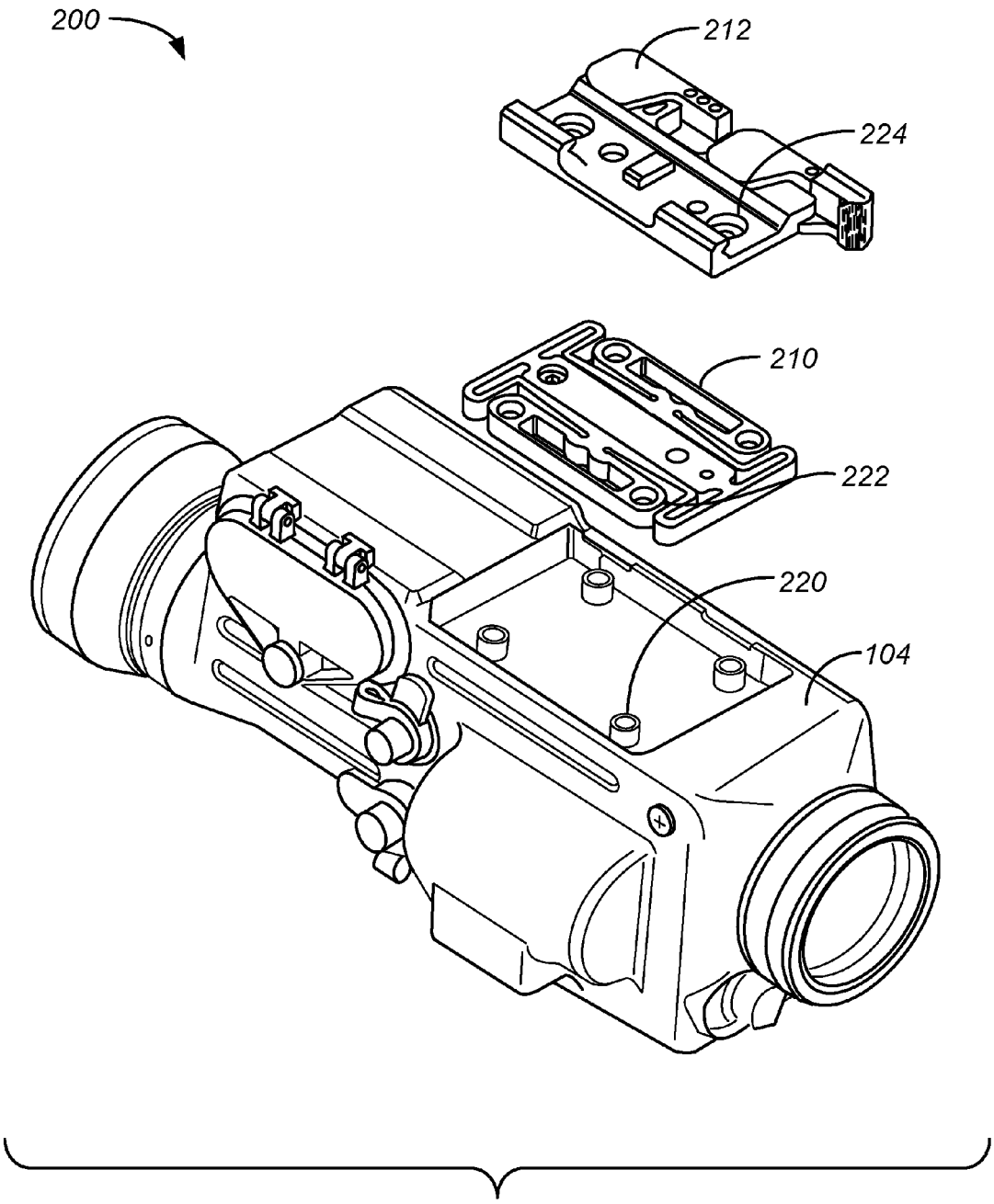
FIG. 2B illustrates an exemplary night vision sight situated upside down, according to embodiments of the present invention.
Figure 2C:
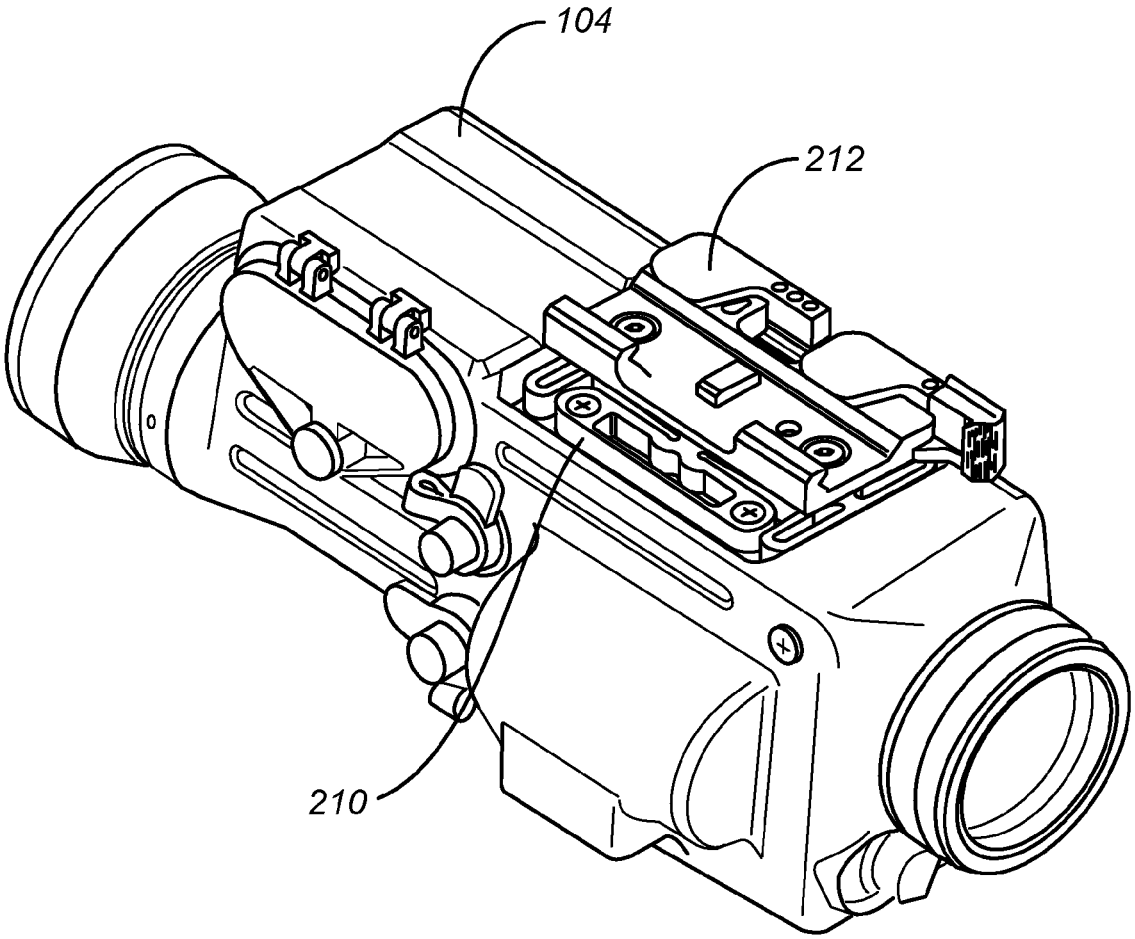
FIG. 2C illustrates an exemplary night vision sight situated upside down, according to embodiments of the present invention.

FIGS. 2A-2C show night vision and attenuator system 200. System 200 includes night vision sight 104, attenuator 210 and rail grabber 212. FIG. 2A shows night vision sight 104 situated shown in FIG. 1, or as it would be situated when connected to accessory rail 108 and the gun that is attached to accessory rail 108, according to embodiments of the present invention. FIGS. 2B and 2C show night vision sight 104 situated upside down for convenience to view the coupling between the night vision sight 104, attenuator 210, and rail grabber 212. Rail grabber 212 is a mechanism configured to couple an accessory, such as an optical device, to a gun or an accessory rail of a gun.

As shown in FIG. 2A, attenuator 210 can be mounted between night vision sight 104 (or any other sight configured to be used with such an attenuator) and rail grabber 212. Attenuator 210 is mounted between night vision sight 104 and rail grabber 212 (and therefore the gun connected to rail grabber 212) to physically isolate night vision sight 104 from rail grabber 212 and the gun that it is connected to to attenuate a portion of the shock traveling to the optical device from the gun.

As shown in FIG. 2B, night vision sight 104 includes sight screw receivers 220, attenuator 210 includes attenuator screw receivers 222, and rail grabber 212 includes rail grabber screw receivers 224. Sight screw receivers 220 are shown in FIG. 2B as protrusions that sit in an opening of night vision sight 104. Attenuator screw receivers 222 and rail grabber screw receivers 224 are shown in FIG. 2B as holes or orifices through attenuator 210 and rail grabber 212, respectively. Sight screw receivers 220, attenuator screw receivers 222 and rail grabber screw receivers 224 are each configured to fit into or around one another such that a set of screws could protrude through attenuator screw receivers 222 and rail grabber screw receivers 224 and into sight screw receivers 220 so as to fasten attenuator 210 and rail grabber 212 to night vision sight 104 as shown in FIG. 2C. Although one specific embodiment of sight screw receivers 220, attenuator screw receivers 222 and rail grabber screw receivers 224 and the configuration in which they work to fasten attenuator 210 and rail grabber 212 to night vision sight 104, various other methods of coupling/fastening attenuator 210 and rail grabber 212 to night vision sight 104 are possible and are understood to be within the scope of the present technology. Furthermore, FIGS. 2A-2C show embodiments with specific shapes and configurations of attenuator 210; Various different shapes and configurations of attenuator 210 may be used and will be discussed further herein.

Figure 3A:
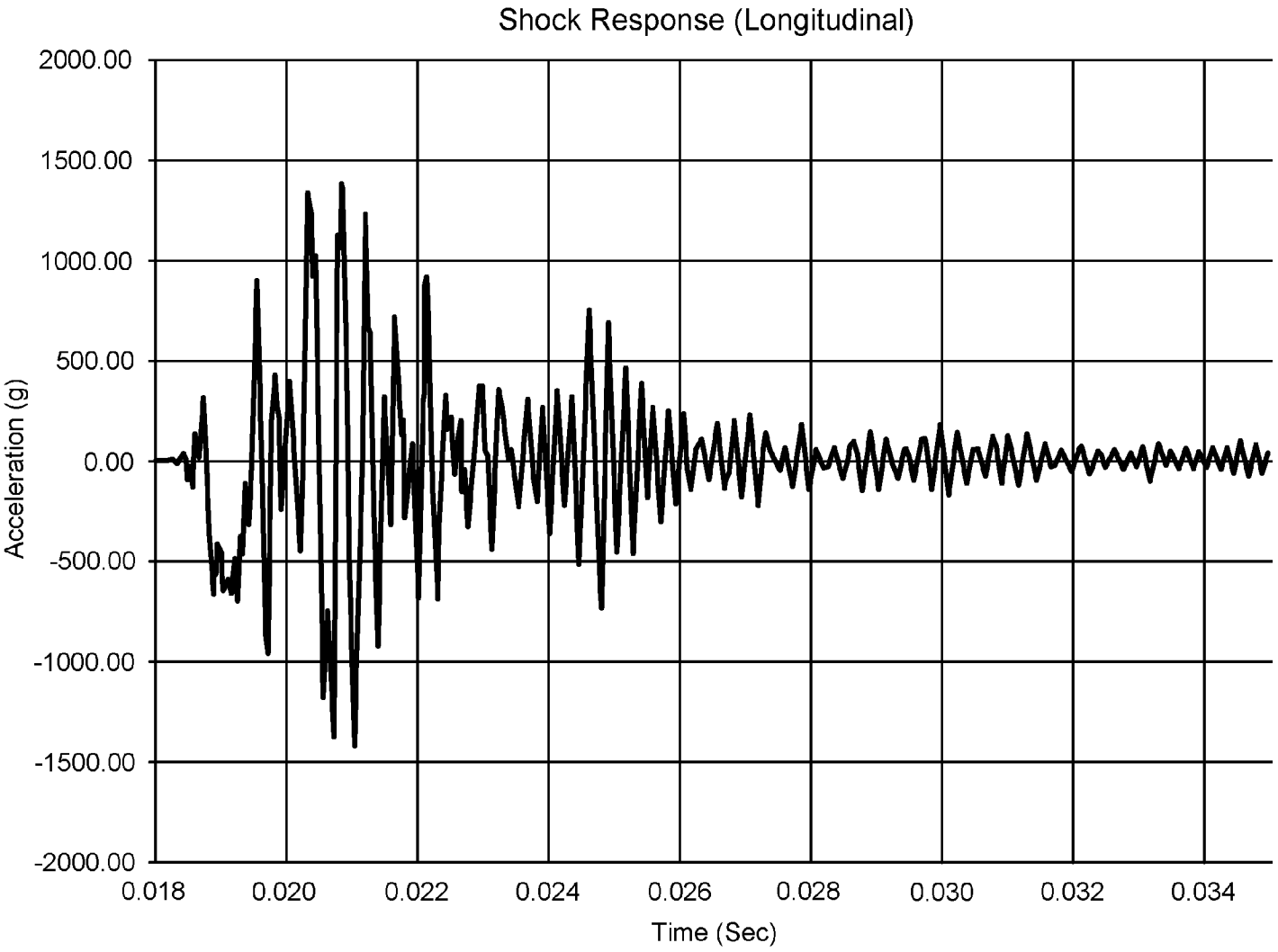
FIG. 3A illustrates an acceleration time history of the shock generated by a gun in a direction or along an axis longitudinal along the length of the gun, according to embodiments of the present invention.
Figure 3B:
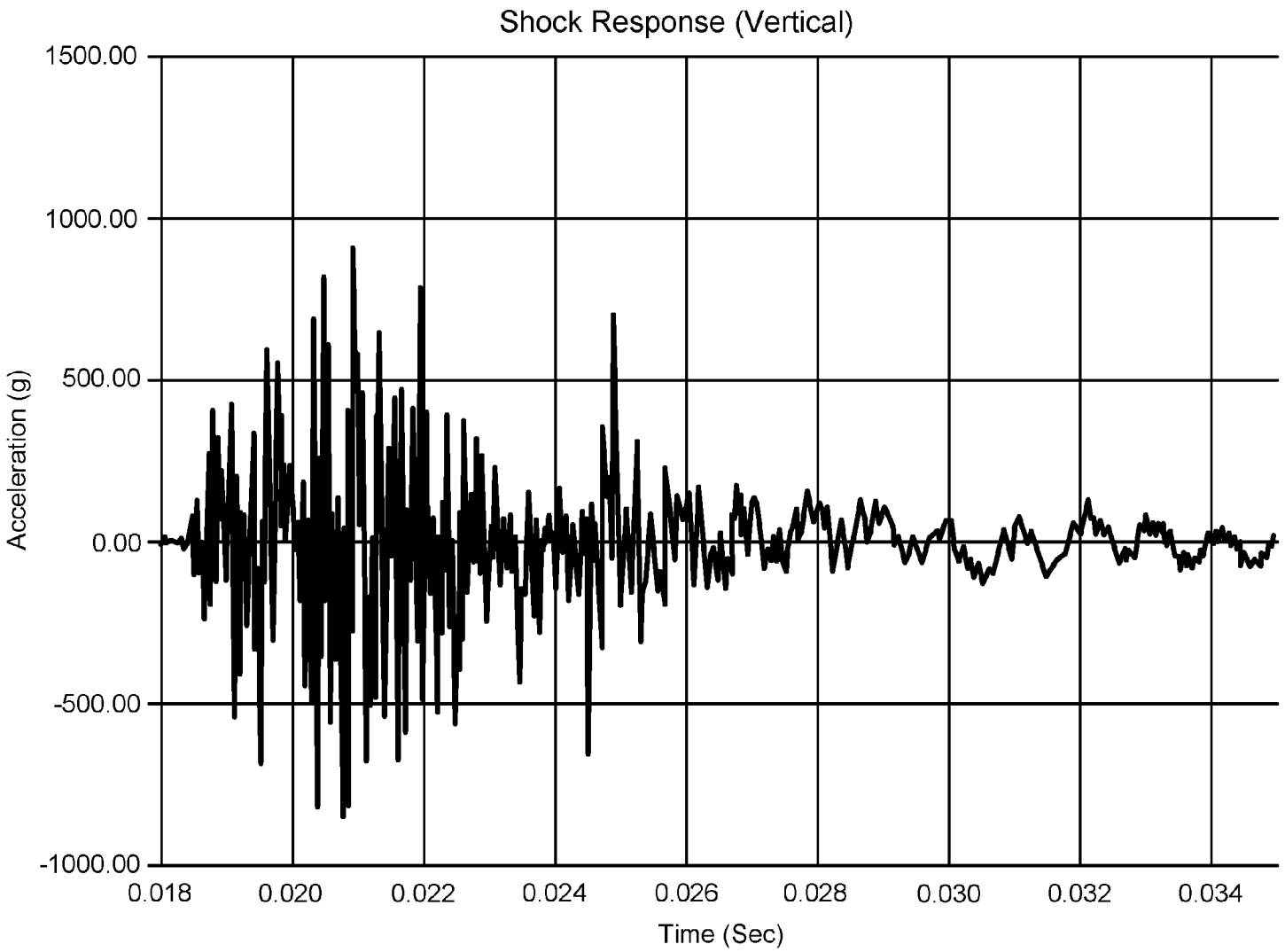
FIG. 3B illustrates an acceleration time history of the shock generated by a gun in a direction or along an axis vertical from the gun, according to embodiments of the present invention.
Figure 3C:
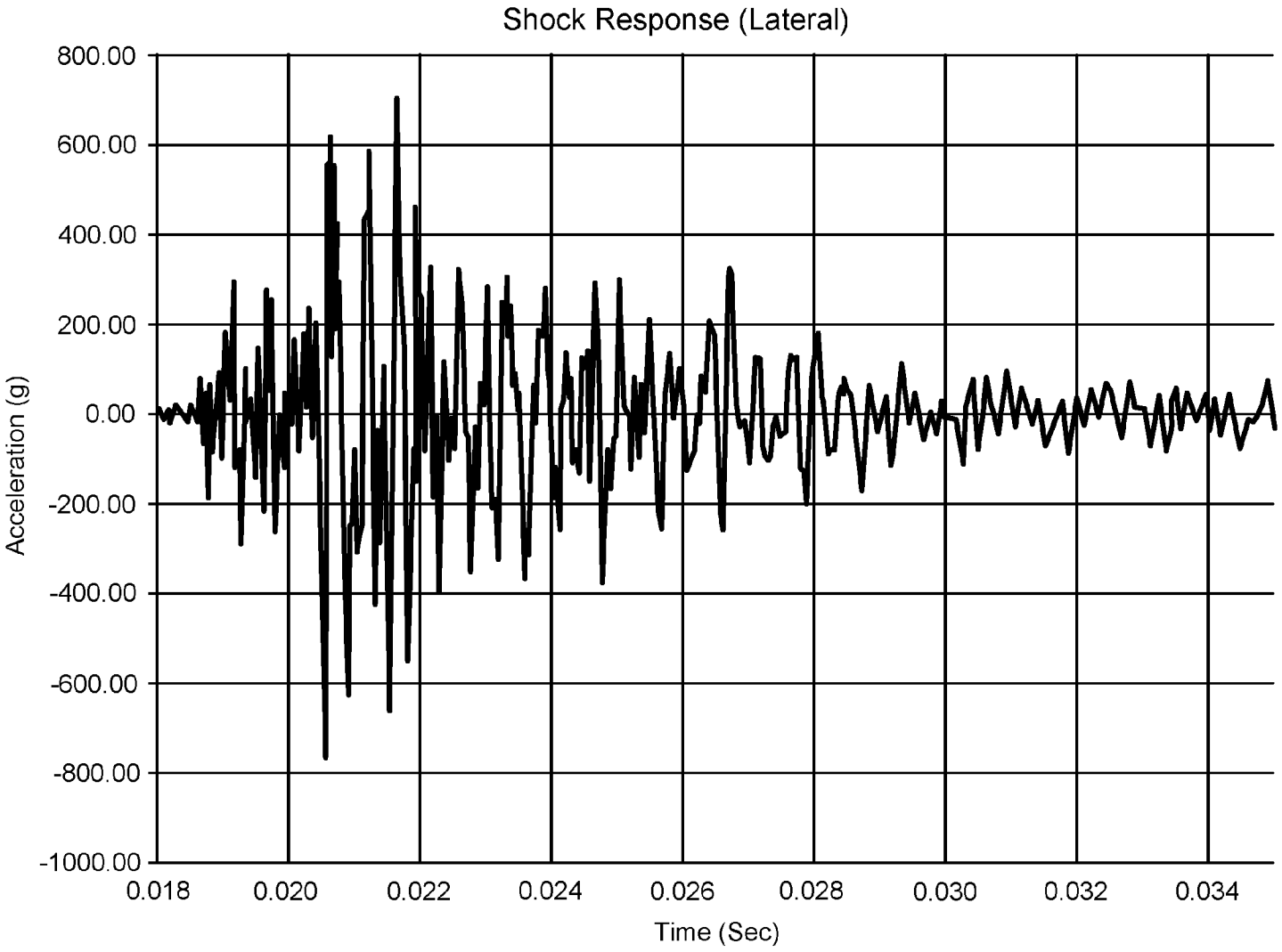
FIG. 3C illustrates an acceleration time history of the shock generated by a gun in a direction or along an axis lateral from the gun, according to embodiments of the present invention.

As noted, since an optical device is generally directly connected to an accessory rail of the gun, the optical device may experience severe shock when the gun is fired that travels from the gun to the optical device through the accessory rail so as to damage the optical device. FIGS. 3A-3C show representations of the shock that such an optical device may experience during the firing of a gun that it is attached to. More specifically, FIGS. 3A-3C illustrate the acceleration time history for an exemplary rifle when the rifle is shot, or more specifically a graphical representation of the acceleration (in g's) over time (in seconds) of the shock experienced on a rifle when the rifle is shot.

FIG. 3A shows the acceleration time history of the shock generated by the gun in a direction or along an axis longitudinal along the length of the gun (in other words, along the length of an optical device coupled to the top of the gun), according to embodiments of the present invention. FIG. 3B shows the acceleration time history of the shock generated by the gun in a direction or along an axis vertical from the gun (in other words, moving up and down towards the top and bottom of the gun and orthogonal to the barrel of the gun), according to embodiments of the present invention. FIG. 3C shows the acceleration time history of the shock generated by the gun in a direction or along an axis lateral from the gun (in other words, moving out from the sides of the gun and orthogonal to the barrel of the gun), according to embodiments of the present invention. As shown in FIGS. 3A-3C, the gun generates a shock response of consistently greater than 250 g's. For example, as shown in FIG. 3A, the gun generates a maximum shock response of approximately 1400 g's in the longitudinal direction (at approximately the 0.0210 mark), as shown in FIG. 3B, the gun generates a maximum shock response of approximately 900 g's in the vertical direction (at approximately the 0.0210 mark), and as shown in FIG. 3C, the gun generates a maximum shock response of approximately 700 g's in the lateral direction (at approximately the 0.0215 mark). Since the shock response generated by the gun, and therefore felt by an optical device connected to the gun, is so high, the optical device is at great risk of being damaged by that shock.

Figure 4:
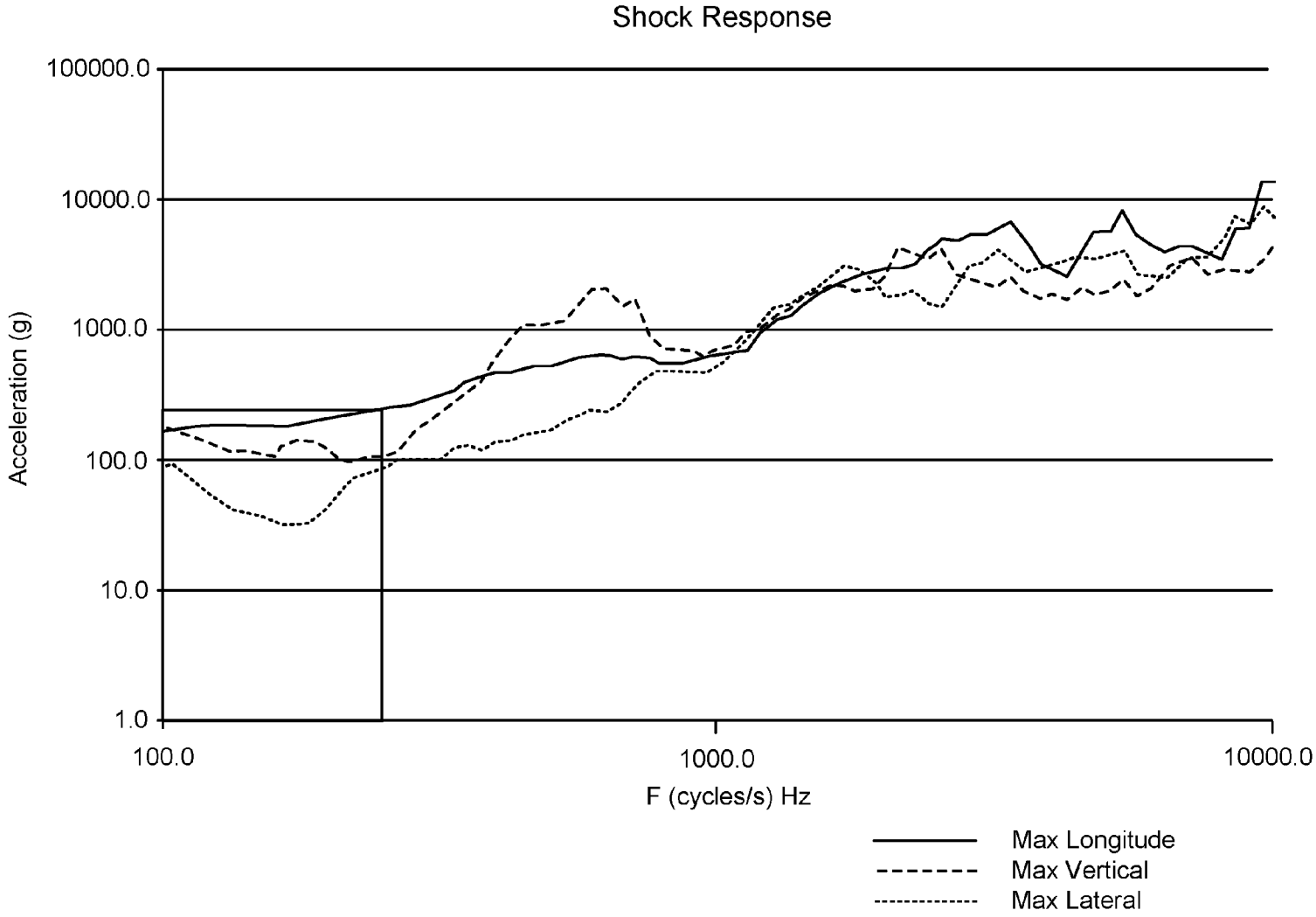
FIG. 4 illustrates a frequency domain representation of the temporal data of shock response shown in FIGS. 3A-3C, according to embodiments of the present invention.

FIG. 4 shows the frequency domain (acceleration in g's vs. Hertz) representation of the temporal data of shock response (acceleration in g's vs. time in seconds) shown in FIGS. 3A-3C, according to embodiments of the present invention. Furthermore, as shown in FIG. 4, FIG. 4 includes the frequency domain graphs of maximum acceleration for each of the longitudinal, vertical and lateral directions. FIG. 4 also shows a horizontal line, which intersects both with the y axis of the graph and with the maximum longitude plot. As such, FIG. 4 illustrates that a significant portion of the frequency domain shock spectrum yields an acceleration of above 250 g's. In other words, each point on each of the plots that sit above the 250 g line represent frequencies with accelerations of greater than 250 g's, and should be attenuated in order to achieve a shock response for a gun that does not generate shock of greater than 250 g's and may not damage accessories attached to the gun. As noted, embodiments of the present shock attenuator technology can be mounted between, for example, the gun and an optical device so as to reduce the shock felt by the optical device from as much as several thousand g's or more down to a predetermined level (for example to below a g loading of 250 g's).

Figure 5A:
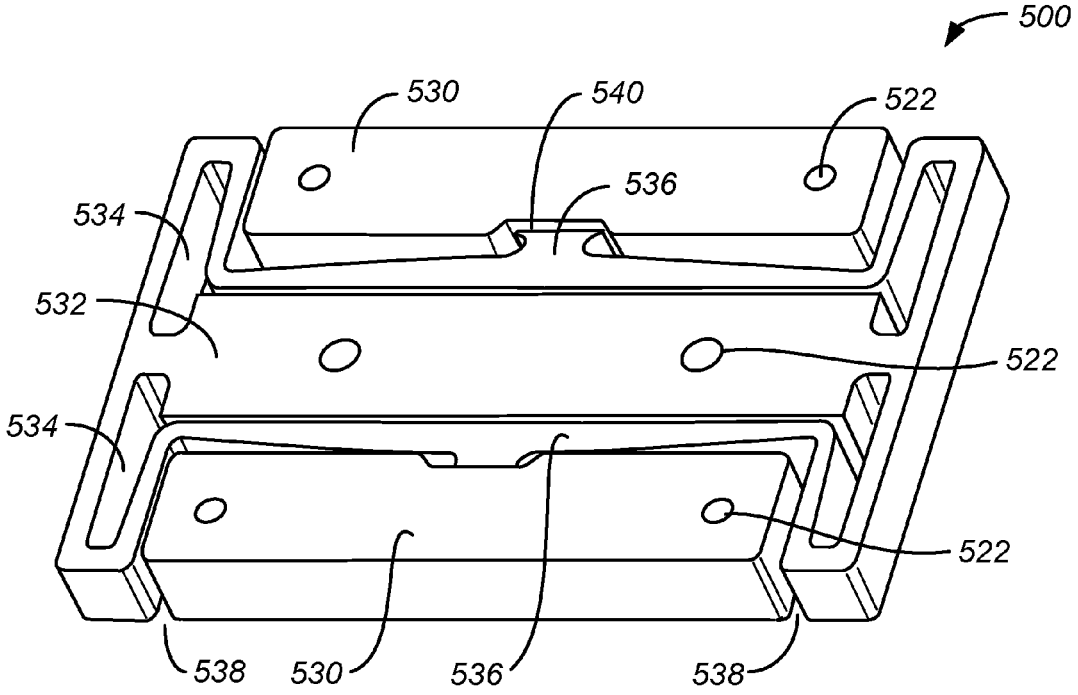
FIG. 5A illustrates a perspective view of an embodiment of a shock attenuator, according to embodiments of the present invention.

FIGS. 5A-7E show various embodiments of the shock attenuator used to reduce a gun's shock to, for example, below 250 g's. FIG. 5A shows a perspective view and FIG. 5B shows a top view of a first embodiment of a shock attenuator 500, according to embodiments of the present invention. Shock attenuator 500 includes, for example, outer rail supports 530 (or optical device rail supports) and inner rail support 532 (weapon rail supports). Outer rail supports 530 and inner rail support 532 are substantially parallel to each other with inner rail support 532 in between outer rail supports 530. Note that although outer rail supports 530 and inner rail support 532 include the spatial reference terms "outer" and "inner" respectively, outer rail supports 530 and inner rail support 532 may not necessarily be located on the outer or inner portion of the attenuator. Attenuator 500 also includes spring features 536, which are located between inner rail support 532 and each of outer rail supports 530. Spring features 536 substantially isolate outer rail supports 530 and inner rail support 532 from each other. Although spring features 536 may be in direct contact with both outer rail supports 530 (via, for example, connection 540) and inner rail support 532 at different points along spring features 536, such connections are separated by such a physical distance that outer rail supports 530 and inner rail support 532 are isolated from each other to the point where any shock, vibrations, or other signals traveling from inner rail support 532 through spring features 536 may/should not reach outer rail supports 530 (and any that does reach outer rail supports 530 would be minimal and would not damage any optical sight connected to inner rail support 532. Spring features 536 allow for slight movement of the rail supports with respect to each other so as to reduce shock transferred between the rail supports (and, therefore, between the weapon and the optical device attached to the respective rail supports).

As shown in FIGS. 2A-2C, the attenuator can be mounted between a night vision sight (or any other sight configured to be used with such an attenuator) and a rail grabber to physically isolate the night vision sight from rail grabber and the gun that it is connected to. To connect attenuator 500 to, for example, to a night vision sight and/or rail grabber, attenuator 500 includes attenuator screw receivers 522 in both outer rail supports 530 and inner rail support 532. Attenuator screw receivers 522 correspond to attenuator screw receivers 222 in FIG. 2B. However, the placement of attenuator screw receivers may be adjusted and perform the same function. Furthermore, as noted, attenuator 500 may be connected to a night vision sight, rail grabber or other device in ways other than using attenuator screw receivers (thereby rendering the screw receivers useless) if such methods are used.

Outer rail supports 530 are configured to couple attenuator 500 to an optical device, such as optical device 102 shown in FIG. 1. Inner rail support 532 is configured to couple attenuator 500 to a gun, or to a rail grabber, such as rail grabber 212 in FIGS. 2A-2C. Because different portions of attenuator 500 are connected to the gun/rail grabber (inner rail support 532) and to the optical device (outer rail supports 530), and because outer rail supports 530 and inner rail support 532 are isolated from each other within attenuator 500, attenuator 500 is configured to attenuate/isolate shock generated by the gun before it reaches the optical device.

Although FIG. 5A shows two outer rail supports 530 and one inner rail support 532, embodiments of the present invention may include different numbers of inner and outer rail supports. Furthermore, the configuration of attenuator 500 may also be adjusted and still fit within the scope of the technology of the present technology. For example, outer rail supports 530 and inner rail support 532 may be in a configuration other than being substantially parallel to each other and/or may be connected to each other in different ways.

Figure 5B:
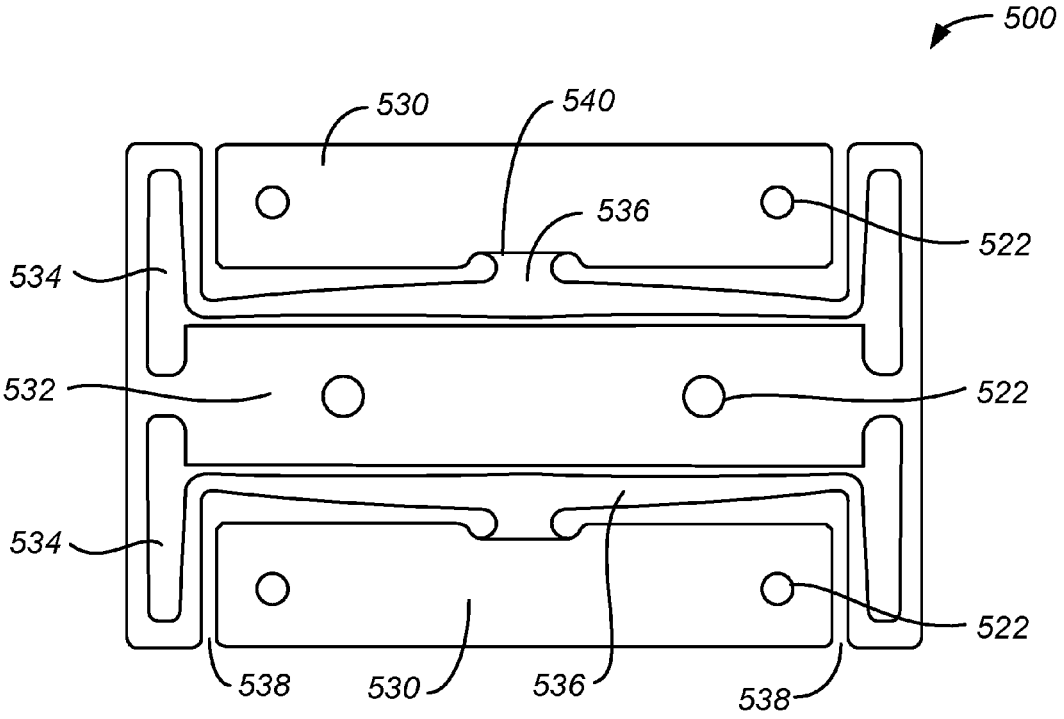
FIG. 5B illustrates a top view of an embodiment of a shock attenuator, according to embodiments of the present invention.

Referring back to spring features 536, various different configurations of spring features 536 are also contemplated. Spring features 536 shown in FIGS. 5A and 5B are configured such that they create openings 534. Specifically, an opening 534 is created by each spring feature 536. Each opening 534 extends from one end of attenuator 500 to the other end of attenuator 500. Openings 534 allow for spring feature 536 (and, in turn, outer rail support 530) to move towards and away from inner rail support 532 when a shock or vibration is received at attenuator 500 such that the side of the inner rail support 532 along the length of spring feature 536 adjacent to spring feature 536 does not contact spring feature 536. The configuration of spring features 536 also allow for openings 538 in between spring features 536 and outer rail supports 530. Openings 538 allow for outer rail support 530 to move towards and away from spring features 536 when a shock or vibration is received at attenuator 500 such that the side of each outer rail support 530 along the length of outer rail support 530 adjacent to spring feature 536 does not contact spring feature 536. In other words, as noted, spring features 536, openings 534 and openings 538 allow for outer rail supports 530 (and any optical device or other device attached to outer rail supports 530) to be substantially or fully physically isolated from inner rail support 532 (and any rail grabber, gun or other device connected to inner rail support 532).

Figure 5C:
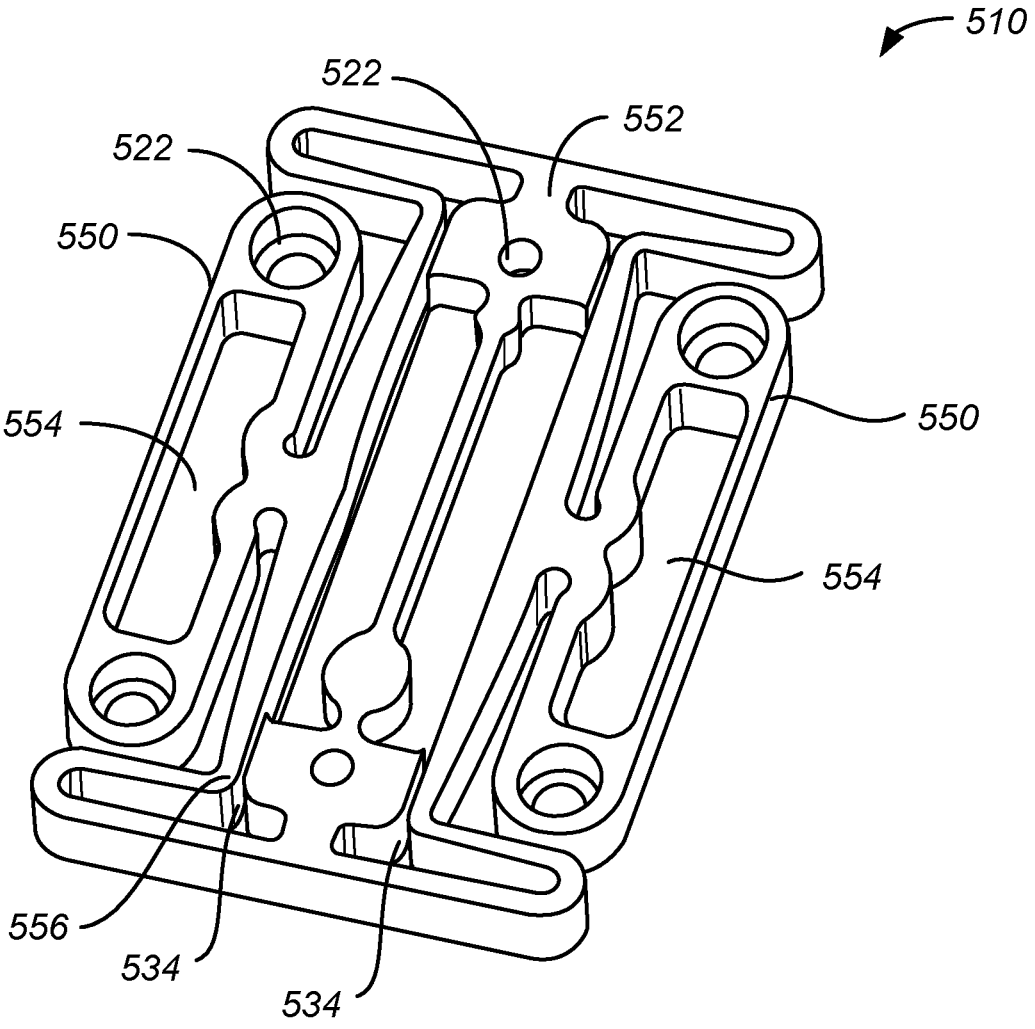
FIG. 5C illustrates a perspective view of an attenuator, a variation of the attenuator shown in FIGS. 5A and 5B, according to embodiments of the present invention.

FIG. 5C shows a perspective view of attenuator 510, a variation of attenuator 500, according to embodiments of the present invention. Attenuator 510 is similar to attenuator 500, but has outer rail supports 550 and inner rail support 552 that include holes or openings (lightening features 554) to reduce the overall mass, weight and compactness of the attenuator. For example, attenuator screw receivers 522 have been shifted to the ends of each of outer rail supports 530 and inner rail support 532 and a substantial portion of the middle portion of each of outer rail supports 530 and inner rail support 532 have been removed. Lightening features 554 reduce the overall weight of the attenuator so that when the attenuator is added to the gun and optical device system, the least amount of weight is added to the system while still reducing the shock received by the optical device as much as possible. The weight of attenuator 510 is further reduced because outer rail supports 550, inner rail support 552 and spring features 556 each have rounded edges to remove extra material from the corners of each of those elements when compared to attenuator 500. Furthermore, the compactness of the attenuator allows the weapon system to maintain acceptable boresight with respect to the optical device.

Figure 6A:
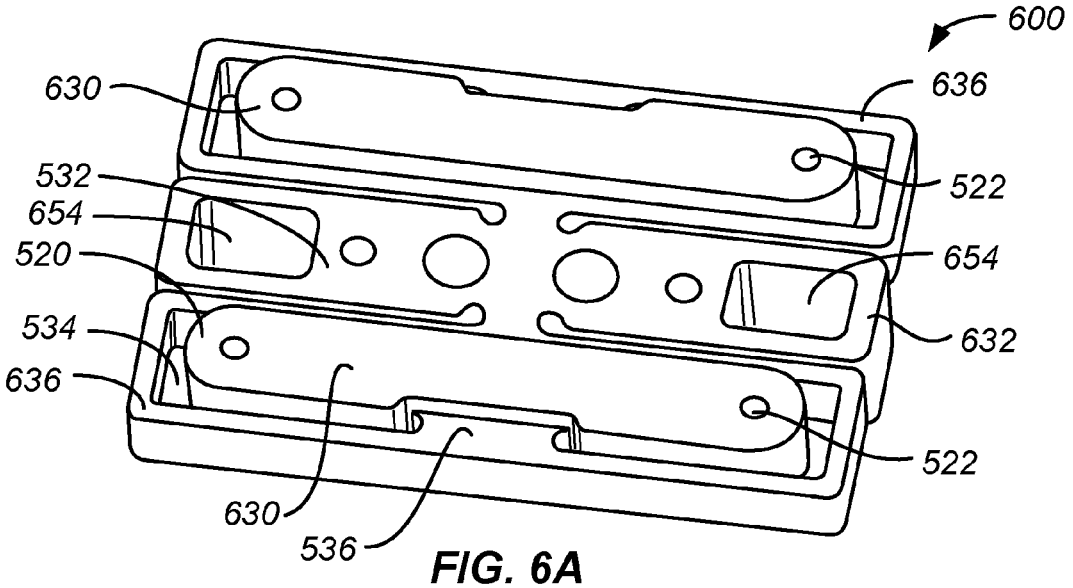
FIG. 6A illustrates a perspective view of an embodiment of a shock attenuator, according to embodiments of the present invention.
Figure 6B:
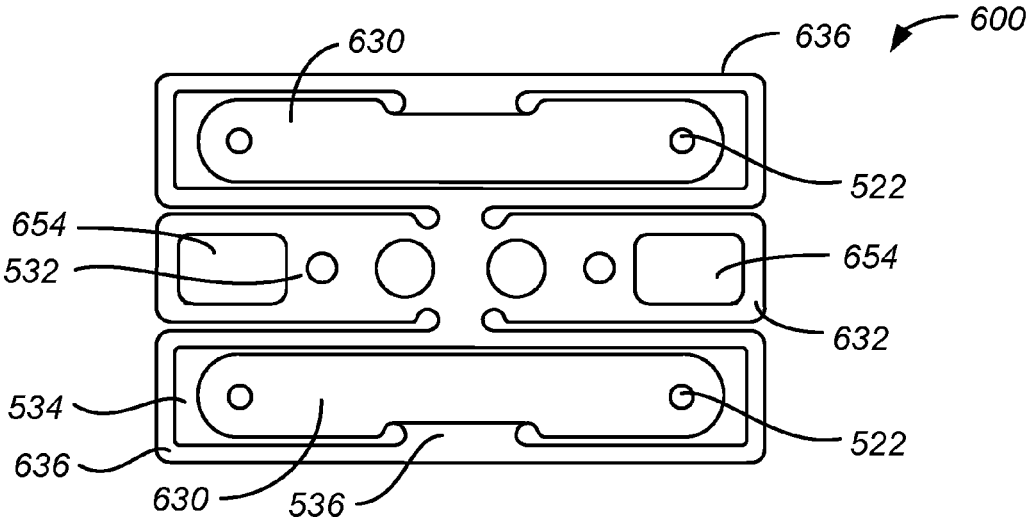
FIG. 6B illustrates a top view of an embodiment of a shock attenuator, according to embodiments of the present invention.

FIG. 6A shows a perspective view and FIG. 6B shows a top view of a second embodiment of a shock attenuator 600, according to embodiments of the present invention. Shock attenuator 600 has some similar characteristics to attenuator 500 from FIGS. 5A-5B, including that attenuator 600 includes outer rail supports, such as outer rail supports 630, an inner rail support, such as inner rail support 632, and spring features, such as spring features 636. However, spring features 636 are connected to inner rail support 632 and to outer rail supports 630 in a different way than the corresponding connections/relationship in attenuator 500 in FIGS. 5A and 5B. More specifically, spring features 636 are connected to outer rail supports 630 on a different side of outer rail supports 630 than for attenuator 500, and namely the opposite side of outer rail supports 630 that is the side along the length of outer rail supports 630 farthest away from inner rail support 632. This configuration, where spring features 636 are connected to outer rail supports 630 on the outside walls of outer rail supports 630, provides a longer path for shock to travel from the gun (which is, as noted, connected to the inner rail support 632) to the optical device (which is, as noted, connected to the outer rail supports 630). Such a longer path allows for attenuator 600 to attenuate any shock traveling through attenuator 600 to be dissipated more than for a shorter path.

Figure 6C:
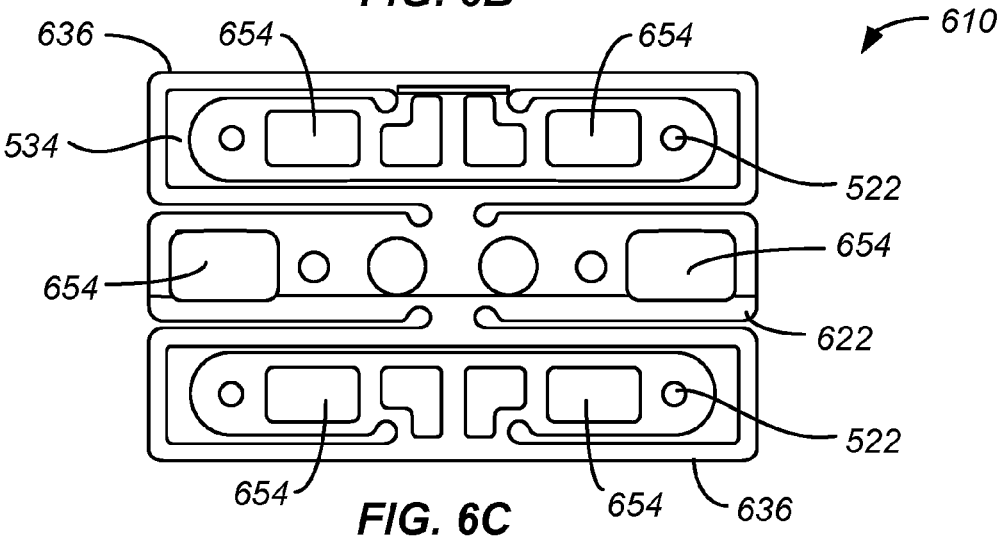
FIG. 6C illustrates a top view of a variation of the embodiment of a shock attenuator shown in FIGS. 6A and 6B, according to embodiments of the present invention.

FIG. 6C shows a top view of a variation of the second embodiment of a shock attenuator 600, attenuator 610, according to embodiments of the present invention. Shock attenuator 610 has similar features to attenuator 600, including outer rail supports, such as outer rail supports 630, an inner rail support, such as inner rail support 632, and spring features, such as spring features 636. However, a substantial portion of the middle portion of each of outer rail supports 630 and inner rail support 632 have been removed. Such removed portions are labeled lightening features 654. Lightening features 654 reduce the overall weight of the attenuator so that when the attenuator is added to the gun and optical device system, the least amount of weight is added to the system while still reducing the shock received by the optical device as much as possible.

Figure 7A:
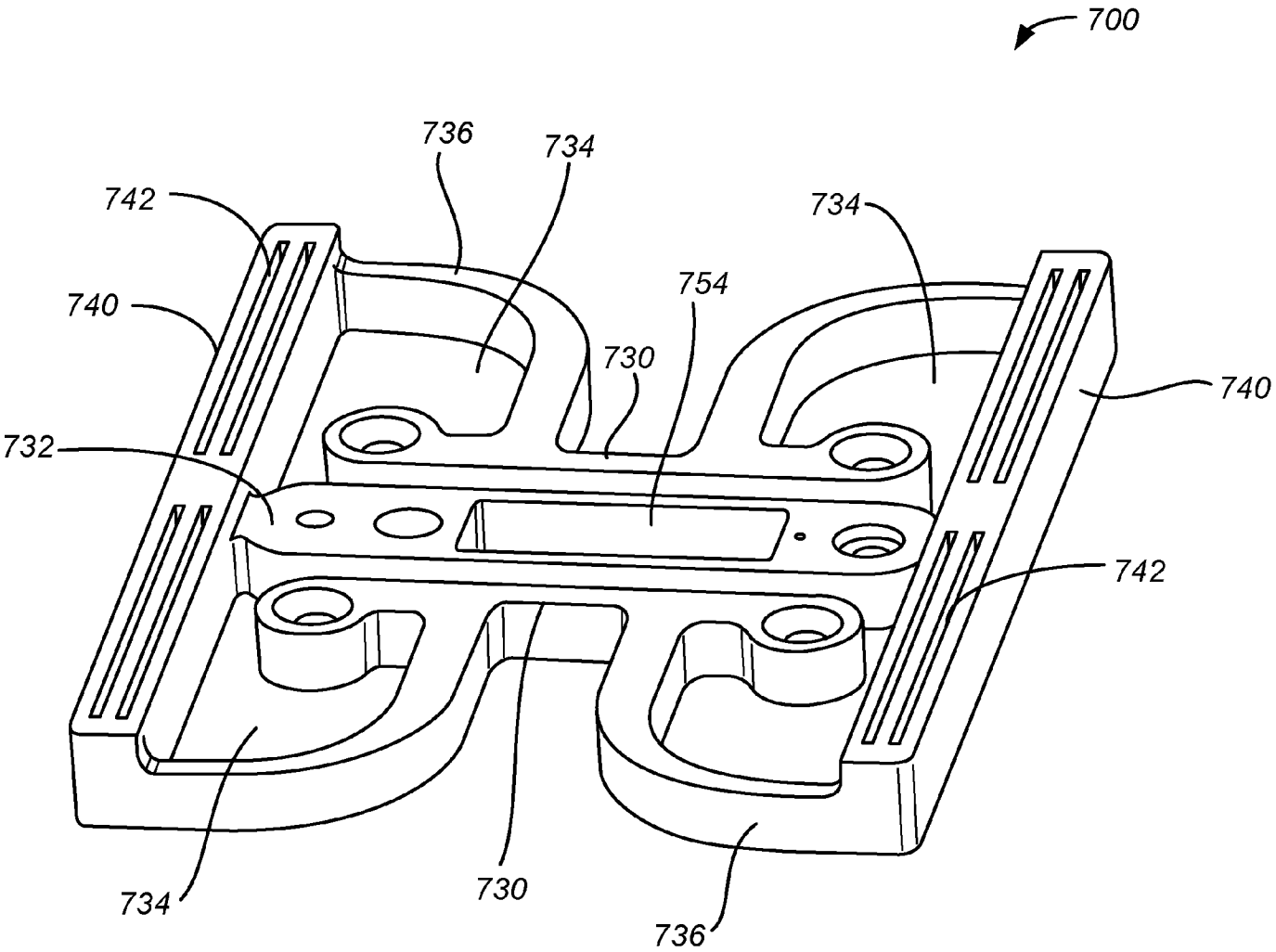
FIG. 7A illustrates a perspective view of an embodiment of a shock attenuator, according to embodiments of the present invention.

FIG. 7A shows a perspective view of a third embodiment of the shock attenuator, attenuator 700, according to embodiments of the present invention. Shock attenuator 700 includes inner rail support 732, outer rail supports 730 and spring features 736 similar to, for example, attenuator 600. However, attenuator 700 includes four spring features 736. Each outer rail supports 730 are connected to two spring features 736. However, spring features 736 do not wrap entirely around outer rail supports 730, but instead each spring feature 736 connects on its opposite end from the outer rail support 730 to a side rail 740. Side rails 740 extend along the entire width of attenuator 700 and connect to one spring feature on each side of attenuator 700 and one end of inner rail support 732, as shown in FIG. 7A. Side rails 740 include side rail openings 742 as shown in FIG. 7A. Side rail openings 742 may take on a similar role as lightening feature 754 in inner rail support 732 such that they reduce the overall weight of the attenuator so that when the attenuator is added to the gun and optical device system, the least amount of weight is added to the system while still reducing the shock received by the optical device as much as possible. Furthermore, outer rail supports 730 are thinner and include less mass than outer rail supports 630 or 530, which may have the same effect. Attenuator 700 includes openings 734, both between spring features 736 and side rails 740 and also between outer rail supports 730 and inner rail support 732. Such openings may also have the same effect as lightening features 754 and side rail openings 742.

Figure 7B:
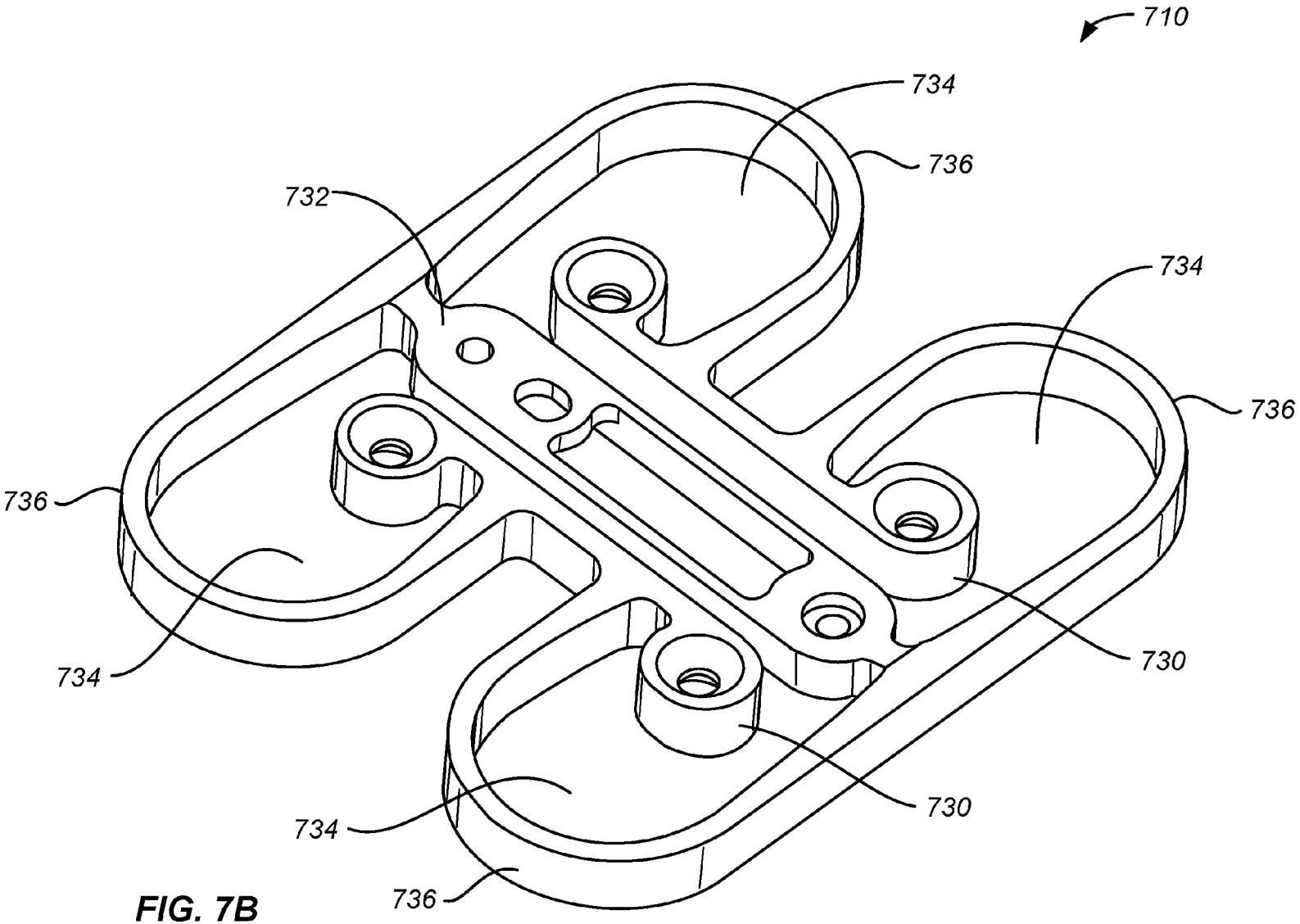
FIG. 7B illustrates a perspective view of an embodiment of a shock attenuator, according to embodiments of the present invention.

FIG. 7B shows a perspective view of an exemplary attenuator, attenuator 710, according to embodiments of the present invention. Shock attenuator 710 is similar to attenuator 700 shown in FIG. 7A, but does not include side rails 740. Instead, spring features 736 wrap around outer rail supports 730 and connect to inner rail support 732. Spring features 736 may be thinner than side rails 740 and thus provide for an attenuator with reduced mass/weight as compared to attenuator 700.

The shock attenuator/isolator can be manufactured from various materials, including high strength steel, which can allow the shock isolator to withstand very high operating stresses in a relatively compact, lightweight shape. In an embodiment, the material can be a composite, such as carbon fiber, Kevlar, fiberglass, or a combination of these together. In an embodiment, the material may be a metal or metal alloy, such as beryllium copper alloy, stainless steel, nickel and nickel-copper (e.g., "super alloys"), titanium, titanium alloy, or other high strength alloys. Therefore, such materials are tough and high strength to withstand severe shock received from a gun during gunfire.

Figure 7C:
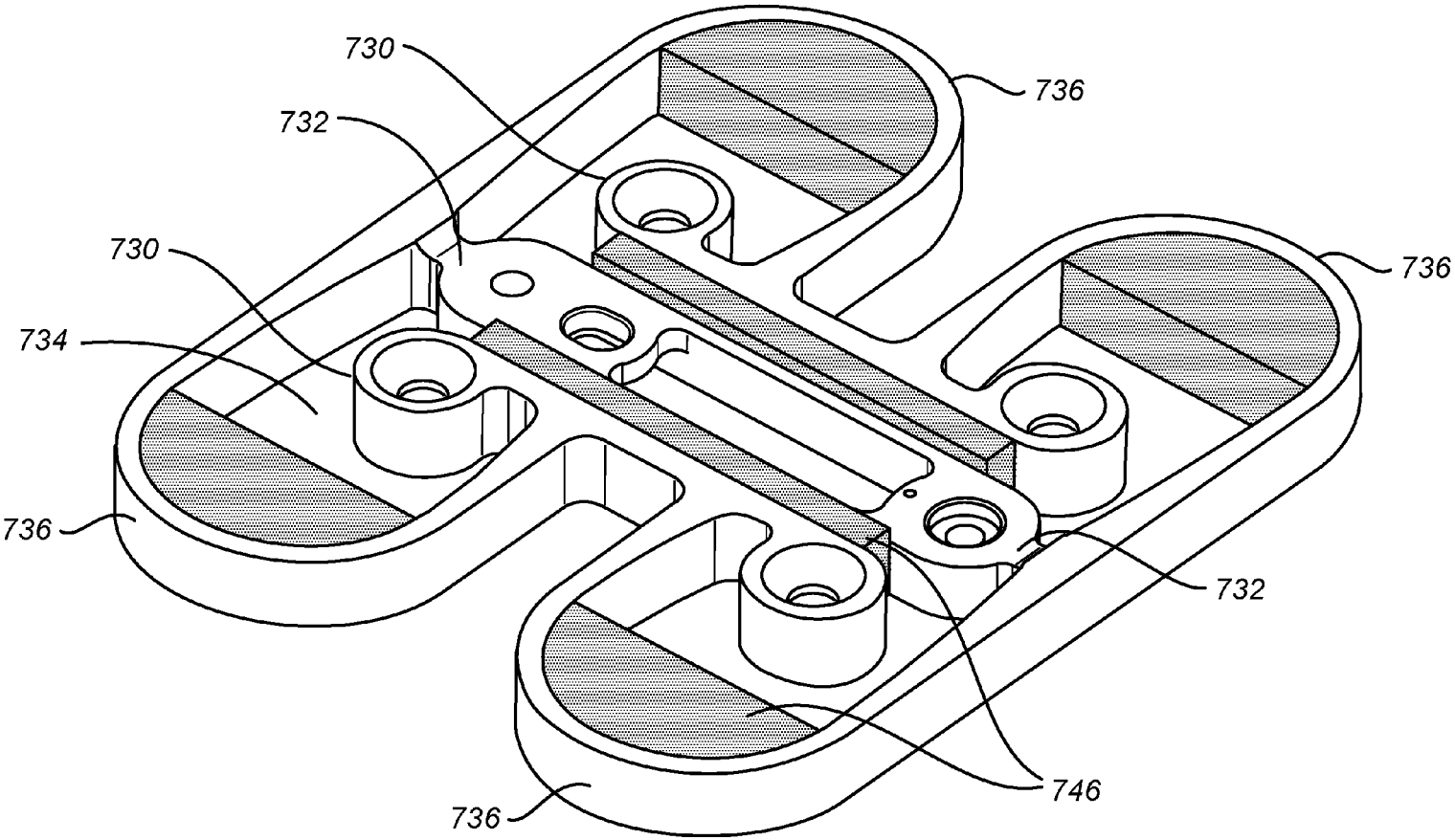
FIG. 7C illustrates a perspective view of an embodiment of a shock attenuator, according to embodiments of the present invention.

FIG. 7C shows a perspective view of an exemplary attenuator, attenuator 720, according to embodiments of the present invention. Attenuator 720 is similar to attenuator 710 shown in FIG. 7B, but also includes an extra material, such as, for example, a viscoelastic material, inserted into certain open/empty portions of the attenuator. As shown, the material such as viscoelastic material 746 is inserted in between the outer rail supports 730 and the inner rail support 732 and inside portions of openings 734 along the inside rim of spring feature 736, as shown in FIG. 7C. Viscoelastic materials allow for the portions of attenuator 720 that the materials support to stretch/strain when stress/pressure is applied (such as a shock from an attached gun) and quickly return to their original state once the stress is removed. Such a material allows attenuator 720 to attenuate and resist the effect of such strain when applied to the attenuator. For example, viscoelastic materials 746 allow for outer rail supports 730 to move towards and away from inner rail support 732 without contacting inner rail support 732 and while attenuating any strain applied to inner rail support 732, and vice versa. In other words, the viscoelastic material 746 allow for outer rail supports 530 (and any optical device or other device attached to outer rail supports 730) to be substantially or fully physically isolated from inner rail support 732 (and any rail grabber, gun or other device connected to inner rail support 532). Although FIGS. 7C and 7D show viscoelastic material 746 in certain specific portions or openings of the attenuator, such material or similar material may be located within other portions of a similar attenuator.

Figure 7D:
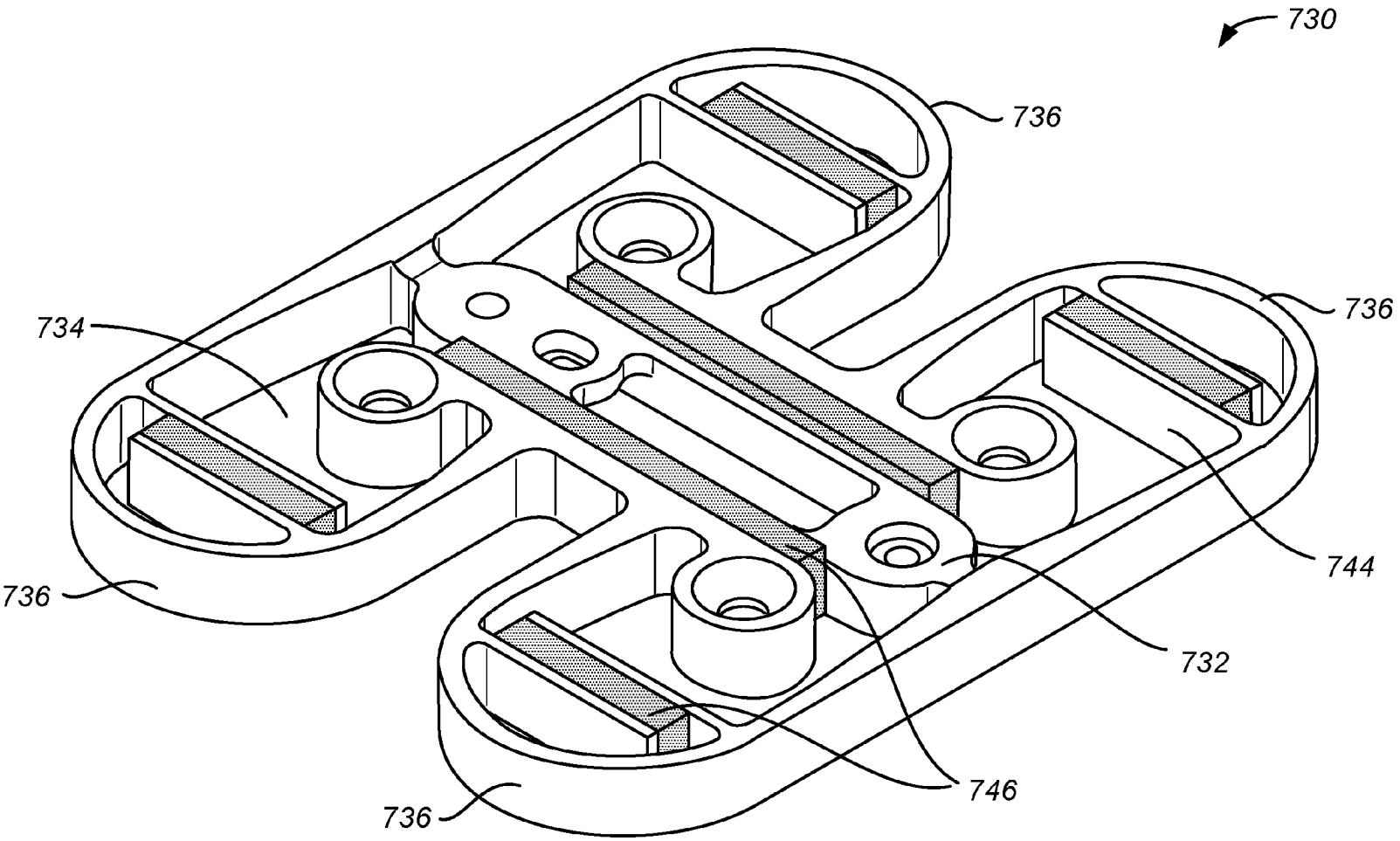
FIG. 7D illustrates a perspective view of an embodiment of a shock attenuator, according to embodiments of the present invention.

FIG. 7D shows a perspective view of an exemplary attenuator, attenuator 730, according to embodiments of the present invention. Attenuator 730 is similar to attenuator 720 shown in FIG. 7C, but does not contain viscoelastic material inside portions of openings 734 along the inside rim of spring feature 736, as shown in FIG. 7C. Instead, attenuator 730 includes two protrusions that extend into openings 734 orthogonal from each side of each spring feature 736 to create material holders 744, as shown in FIG. 7D. Viscoelastic material 746 is inserted in between the two protrusions.

Figure 7E:
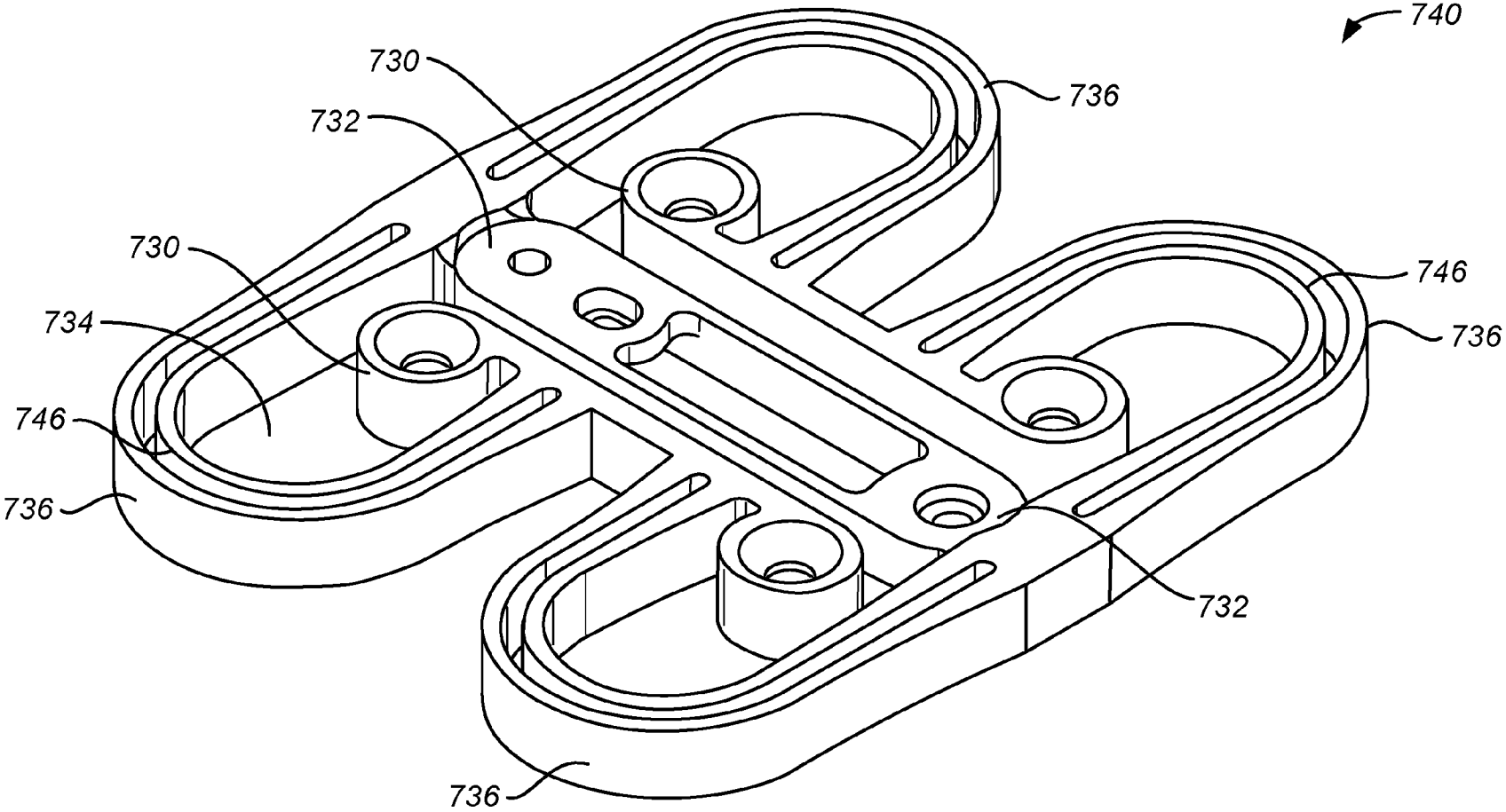
FIG. 7E illustrates a perspective view of an embodiment of a shock attenuator, according to embodiments of the present invention.

FIG. 7E shows a perspective view of an exemplary attenuator, attenuator 740, according to embodiments of the present invention. Attenuator 740 is similar to attenuator 710 shown in FIG. 7B, but also includes spring feature openings 746 within, or openings within spring features 736 of attenuator 740. Spring feature openings 746 may span the entire depth or less than the entire depth of the attenuator and, similar to other openings discussed herein, may allow for a reduction of the overall weight of the attenuator so that when the attenuator is added to the gun and optical device system, the least amount of weight is added to the system while still reducing the shock received by the optical device as much as possible.

As noted, embodiments of the present invention relate to a weapon system with an apparatus, such as an attenuator or isolator, for absorbing shock from a weapon such as a gun (e.g. rifle) to an optical device. Embodiments of the shock attenuator/isolator can relate to an optical principle of a clip on rifle scope that allows the gun/sight system to physically move over small angles without affecting the aim point boresight, as seen through the day view optical scope. The design of the shock attenuator can take advantage of this principle by allowing some physical motion of the system to absorb the bulk of the gunfire shock, providing a level of protection to the optical device.

Figure 8:
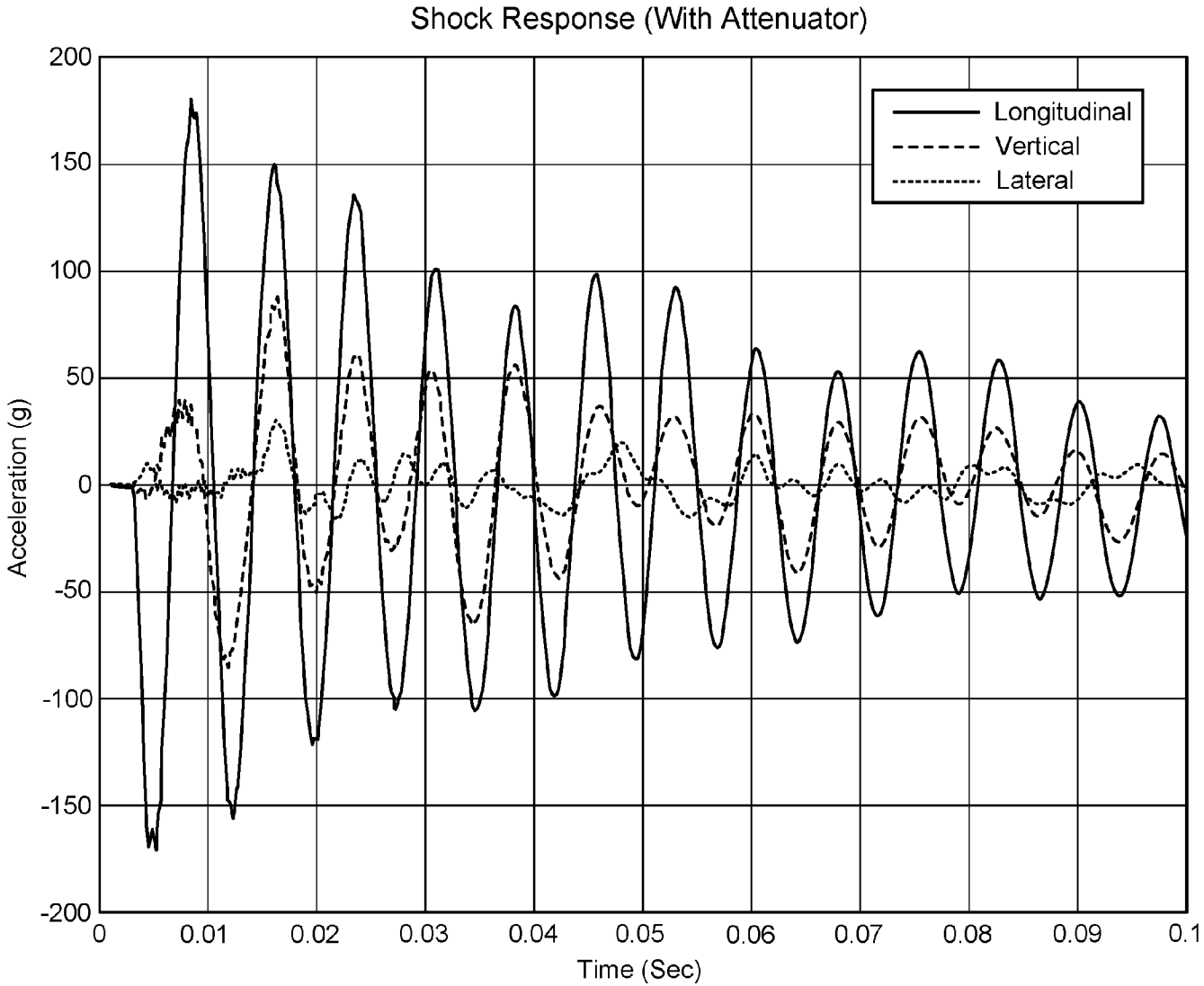
FIG. 8 illustrates an acceleration time history of the shock experienced by the optical device, generated by a gun with an attenuator, according to embodiments of the present invention.

FIG. 8 shows a graph of the shock response (acceleration time history) of the shock created by a gun and optical system indulging the use of an attenuator, according to embodiments of the present invention. More specifically, FIG. 8 shows a graph including one plot of the acceleration time history in a direction or along an axis longitudinal along the length of the gun (in other words, along the length of an optical device coupled to the top of the gun), a second plot of the acceleration time history of the shock created by the gun in a direction or along an axis vertical from the gun (in other words, moving up and down towards the top and bottom of the gun and orthogonal to the barrel of the gun), and a third plot of the sh acceleration time history of the shock created by the gun in a direction or along an axis lateral from the gun (in other words, moving out from the sides of the gun and orthogonal to the barrel of the gun). As shown in FIG. 8, all three plots (shock in the longitudinal, vertical, and lateral directions) have a maximum acceleration of less than 200 g's. More specifically, the plot representing the shock response in a longitudinal direction yields a maximum acceleration of approximately 180 g's, the plot representing the shock response in a vertical direction yields a maximum acceleration of approximately 90 g's, and the plot representing the shock response in a lateral direction yields a maximum acceleration of approximately 40 g's. Therefore, in comparing the data shown by FIG. 8, the gun and optical system using attenuator 720, with the data shown by FIGS. 3A-3C, the gun and optical system without an attenuator according to embodiments of the present invention, the exemplary attenuator reduces/attenuates shock generated by the gun from thousands of g's to below 200 g's. Although the plots of FIG. 8 show these specific maximum accelerations, they are exemplary only. An attenuator according to embodiments of the present invention may similarly yield a maximum acceleration of 250 g's, 249 g's, 248 g's, 247 g's, 246 g's, 245 g's, 240 g's, 235 g's, 230 g's, 225 g's, 220 g's, 215 g's, 210 g's, 205 g's, 200 g's, 195 g's, 190 g's, 185 g's, 180 g's, 175 g's, 170 g's, 165 g's, 160 g's, 155 g's, 150 g's, and so on. As noted, embodiments of attenuators in the scope of the present technology may be used to reduce a shock response (g loading) for a weapon from an initial amount to a predetermined amount less than the initial amount, e.g. from a g loading of several hundred or thousand g's to below 250 g's or 200 g's.

Exemplary weapons that may benefit from embodiments of the present invention are the MK15 .50 caliber, M24, M107, M110, MK13, MK17, MK20, and XM2010 sniper rifles, other rifles or other guns, for example.

Exemplary sights, including the housing of such sites, can incorporate various other components into the optical sight system, including, for example, output connectors (e.g., video output), a purge valve/screw, an external focus mechanism that is at the rear of the sight, a keypad that is accessible for left and right handed shooters, and an on/off/standby switch that allows position to be determined by touch. One example of the threshold length of the sight can be 9.5" (9.0" objective) and height above rail is 4" (3.5" objective), but the lengths/sizes of such sights may vary.

The technology described and claimed herein is not to be limited in scope by the specific preferred embodiments herein disclosed, since these embodiments are intended as illustrations, and not limitations, of several aspects of the technology. Any equivalent embodiments are intended to be within the scope of this technology. Indeed, various modifications of the technology in addition to those shown and described herein will become apparent to those skilled in the art from the foregoing description. Such modifications are also intended to fall within the scope of the appended claims.

What is claimed is:

1. A shock attenuation system configured to reduce shock experienced by an optical device coupled to a weapon, the shock attenuation system comprising:

an inner rail support configured to couple to the weapon;

at least two outer rail supports substantially parallel to the inner rail support, wherein the at least two outer rail supports are configured to couple to the optical device;

a first spring feature coupled to a first of the at least two outer rail supports and the inner rail support, and a second spring feature coupled to a second of the at least two outer rail supports and the inner rail support;

a viscoelastic material coupled to at least one of: the inner rail support, the first outer rail support, the second outer rail support, the first spring feature, or the second spring feature.

2. The shock attenuation system of claim 1, wherein the shock attenuation system is configured to reduce shock experienced by the optical device during operation of the weapon to less than 250 g's.

3. The shock attenuation system of claim 1, wherein the spring features are configured to allow for motion of the outer rail supports with respect to the inner rail support.

4. The shock attenuation system of claim 3, wherein the distance between the inner rail support and each of the outer rail supports is large enough such that the inner rail support and the outer rail supports remain separated during operation of the shock attenuation system.

5. A shock attenuator operable with a weapon and an optical device, the shock attenuator comprising:

a weapon support configured to couple to an accessory rail of the weapon, the weapon being characterized by a predetermined g load during operation;

an optical device support configured to couple to the optical, wherein the optical device support comprises a first outer rail and a second outer rail;

a spring feature configured to couple to the weapon support to the optical device support;

wherein the spring feature comprises:

a first spring feature coupling the first outer rail to the weapon support; and a second spring feature coupling the second outer rail to the weapon support; and a viscoelastic material coupled to at least one of: the first outer rail, the second outer rail, the first spring feature, or the second spring feature;

wherein the shock attenuator is configured to reduce shock experienced by the optical device during operation of the weapon to less than the predetermined g load.

6. The shock attenuator of claim 5, wherein the spring feature is configured to allow for motion of the optical device support with respect to the weapon support.

7. The shock attenuator of claim 5, wherein the shock attenuator is configured to reduce shock experienced by the optical device during operation of the weapon to less than 250 g's.

8. The shock attenuator of claim 7, wherein the predetermined g loading is over 1400 g's.

9. The shock attenuator of claim 5, wherein the shock attenuator is configured to reduce shock experienced by the optical device during operation of the weapon to less than 200 g's.

10. The shock attenuator of claim 5, wherein the viscoelastic material is disposed between the weapon support and the first outer rail and between the weapon support and the second outer rail.

11. The shock attenuation system of claim 1, wherein the viscoelastic material is disposed between the inner rail support and the first of the at least two outer rail supports and between the inner rail support and the second of the at least two outer rail supports.

12. The shock attenuation system of claim 1, wherein the first spring feature and the second spring feature comprise side rails.

13. The shock attenuation system of claim 12, wherein the side rails comprise openings.

14. The shock attenuation system of claim 1, wherein the viscoelastic material is disposed in inside portions of openings along an inside rim of the first spring feature and in inside portions of openings along an inside rim of the second spring feature.

15. The shock attenuation system of claim 1, wherein:

the first spring feature comprises two first protrusions that extend into openings orthogonal from each side of the first spring feature; and the second spring feature comprises two second protrusions that extend into openings orthogonal from each side of the second spring feature.

16. The shock attenuation system of claim 15, wherein the viscoelastic material is disposed between the two first protrusions and between the two second protrusions.

17. The shock attenuator of claim 5, wherein the first spring feature and the second spring feature comprise side rails.

18. The shock attenuator of claim 17, wherein the side rails comprise openings.

19. The shock attenuator of claim 5, wherein the viscoelastic material is disposed in inside portions of openings along an inside rim of the first spring feature and in inside portions of openings along an inside rim of the second spring feature.

20. The shock attenuator of claim 5, wherein:

the first spring feature comprises two first protrusions that extend into openings orthogonal from each side of the first spring feature, wherein the viscoelastic material is disposed between the two first protrusions; and the second spring feature comprises two second protrusions that extend into openings orthogonal from each side of the second spring feature, wherein the viscoelastic material is disposed between the two second protrusions.

* * * * *